United States Patent [19]

Tanaka et al.

[11] Patent Number: 4,980,076

[45] Date of Patent: Dec. 25, 1990

[54] FLUORIDE AND CHROMIUM FREE ACID ETCHANT RINSE FOR ALUMINUM

[75] Inventors: Shigeo Tanaka; Tomoyuki Aoki; Yasuo Iino, all of Kanagawa; Yoji Ono, Tokyo, all of Japan

[73] Assignee: Nihon Parkerizing Co., Ltd., Tokyo, Japan

[21] Appl. No.: 403,625

[22] Filed: Sep. 6, 1989

[30] Foreign Application Priority Data

Sep. 7, 1988 [JP] Japan ..... 63-223798

[51] Int. Cl.[5] ..... C09K 13/04; C09K 13/06; C11D 7/08

[52] U.S. Cl. ..... 252/79.4; 252/79.2; 252/136; 252/142; 156/665; 156/903; 134/3; 134/41

[58] Field of Search ..... 156/903, 665; 252/79.2, 252/79.4, 142, 136, 80, DIG. 1; 134/3, 41

[56] References Cited

U.S. PATENT DOCUMENTS

| | | | |
|---|---|---|---|
| 2,834,659 | 5/1958 | Mathre et al. | 252/79.2 |
| 3,466,192 | 9/1968 | Gardner | 134/3 |
| 4,435,223 | 3/1984 | Dollman | 134/3 |
| 4,707,191 | 11/1987 | Martinou et al. | 134/3 |
| 4,851,148 | 7/1989 | Yamasoe et al. | 134/3 |
| 4,857,225 | 8/1989 | Terada et al. | 252/79.4 |

FOREIGN PATENT DOCUMENTS

| | | |
|---|---|---|
| 56-6981 | 1/1981 | Japan . |
| 58-185781 | 10/1983 | Japan . |
| 61-106783 | 5/1986 | Japan . |
| 61-231188 | 10/1986 | Japan . |

*Primary Examiner*—David L. Lacey
*Assistant Examiner*—Todd J. Burns
*Attorney, Agent, or Firm*—Ernest G. Szoke; Wayne C. Jaeschke; Norvell E. Wisdom, Jr.

[57] ABSTRACT

Problems with previously known aqueous acidic rinsing solutions for aluminum after shaping while using surface lubricants are avoided by use of a solution which contains water and (A) orthophosphoric acid in an amount to give a stoichiometric equivalent of 3.0 to 50 g/L as $PO_4^{-3}$, (B) an aluminum ion sequestrant component in an amount of 0.01 to 10.0 g/L; and (C) 20 to 170 ppm of ferric ion. The ferric ions act to inhibit corrosion of the stainless steel process equipment. Preferably the solution also contains 0.1 to 1.0 g/L of $H_2O_2$, $NO_2^{-1}$ ions, or a mixture thereof to reoxidize ferrous ions formed by reduction of ferric ions during use of the solution and thus maintain the concentration of ferric ions above 20 ppm at all times. The solution may also contain surfactant and up to 10 g/L of dissolved aluminum ions.

19 Claims, No Drawings

FLUORIDE AND CHROMIUM FREE ACID ETCHANT RINSE FOR ALUMINUM

FIELD OF THE INVENTION

This invention relates to a novel acid rinse composition and process which is used for suitably etching and rinsing the surface of aluminum and aluminum alloy plate(s), strip(s), and/or container(s) (hereinafter "aluminum"), particularly in order to remove from the aluminum organic contamination remaining after drawing or other shaping processes have been applied to the aluminum. The compositions and methods according to the invention are effective in accomplishing the amount of etching desired to prepare aluminum for many subsequent surface treatments, and they also avoid or remove the dark discoloration of the surface often produced on aluminum by other processing, including some other etching solutions, and known in the art as "smut".

STATEMENT OF RELATED ART

Up to the present time, acid rinse solutions for aluminum have normally been sulfuric acid/hydrofluoric acid mixtures and have included at least a small quantity of hexavalent chromium in order to prevent rinse equipment corrosion by the rinse solution. However, demand has recently arisen for an acid rinse solution free from fluoride and hexavalent chromium, because of the relatively high cost of treating waste water and drainage containing fluorine-containing complex ions and chromium ions, as well as the technical problems associated with these treatments on-site. Thus, the following inventions, for example, relative to acid rinse solutions for aluminum have appeared in response to this demand:

(a) Japanese Patent Application Laid Open [Kokai] No. 56-6981 [6,981/81], (b) Japanese Patent Application Laid Open No. 58-185781 [185,781/83], and (c) Japanese Patent Application Laid Open No. 61-106783 [106,783/86].

References (a) and (b) are phosphoric acid/sulfuric acid/surfactant systems. As aluminum rinse solutions exploiting the characteristic features of phosphoric acid and sulfuric acid, their rinse performance has considerable merit. However, a problem common to these acid rinse solutions is the severe corrosion of stainless steel process equipment, particularly the stainless steel can hold-down belt conveyers generally used for spray rinsing aluminum cans. The passivating film on the stainless steel surface is destroyed by these acids and corrosion develops. As a result, long-term use of the treatment equipment is not possible.

On the other hand, the acid rinse solution of reference (c) contains sulfuric acid and/or nitric acid as the acidic base, 0.2 to 4 gram per liter (hereinafter "g/L") of ferric ions, and optionally surfactant. This acid rinse solution contains ferric ion as an essential component, and the etching activity of sulfuric acid for the aluminum surface is substantially accelerated by this. However, an operating problem arises with this solution. In practical operation, in order to increase the rinsing efficiency, part of the acid rinse solution is often transferred to a preliminary rinse process in a previous stage and used as a preliminary rinse solution. The pH of this preliminary rinse solution is relatively high and its temperature is high, so that ferric ion introduced into it forms a sludge, resulting in contamination of the preliminary rinse solution. In addition, the sludge clogs the spray nozzles in the spray rinse and the effectiveness of the rinse is reduced.

Moreover, sulfuric acid has only a low etching activity for aluminum. In order to achieve a satisfactory smut removal, high-temperature treatment at 80° to 85° C. is required. This increases the technical difficulty and cost of temperature management for the process.

It is an object of this invention to provide an acid rinse for aluminum that avoids the problems noted above.

DESCRIPTION OF THE INVENTION

In this description, except in the working examples and comparison examples and where expressly noted to the contrary, all numbers specifying amounts of materials or conditions of reaction or use are to be understood as modified by the term "about".

One embodiment of the present invention is an acidic aqueous solution comprising orthophosphoric acid at 3.0 to 50, g/L as $PO_4^{-3}$, 0.01 to 10.0 g/L of an aluminum ion sequestrant component, 20 to 170 parts by weight per million parts by weight of solution (hereinafter "ppm") of ferric ion ($Fe^{+3}$), and sufficient oxidizing agent to maintain the concentration of ferric ion in the solution above 20 ppm during the rinsing of at least 50, preferably at least 100, and more preferably at least 200 square meters of aluminum surface per liter of rinse solution. Ferric ions in initial excess of 20 ppm can serve as this oxidizing agent, but generally another oxidizing agent that is capable of reoxidizing ferrous ion to ferric ion is preferred. More preferably, the oxidizing agent is 0.02 to 3.0 g/L of $H_2O_2$ or $NO_2^-$.

The rinse solution according to this invention has a high permissible aluminum ion content and an excellent retention of its aluminum etching activity, and it either avoids smut formation or produces only a smut that is very readily removed by simple water rinsing. Not only does the solution inhibit corrosion of the rinse equipment, but it also contains no chromium ion or fluoride to contribute to either environmental pollution or waste water treatment expense. Furthermore, this rinse solution does not contain equipment-corrosive chloride or chlorate.

Thus, the rinse solution according to the invention does not contain chromium ion, fluoride, chloride, or chlorate, i.e., none of the aforesaid ions are intentionally added to the rinse solution, and any small amounts of these species that may be present as impurities do not impair the functioning of the solution or increase the cost of its disposal when exhausted or contaminated.

The pH of the acid rinse solution should preferably range from 0.6 to 2.0. Also, surfactant may be added to the rinse solutions according to the invention as desired or needed, preferably in the range of 0.05 to 5.0 g/L, in order to improve the rinse performance.

A drawback to previously known phosphoric acid rinse solutions is that the rinse activity is readily reduced by the presence of aluminum ion dissolved during the rinse process. That is, the etching activity is readily reduced by the aluminum ion, and, in addition, smut tends to remain on the aluminum surface receiving the rinse. In order to maintain the higher etch rate of phosphoric acid relative to sulfuric acid and in order to maintain a satisfactory smut removability, an aluminum ion sequestrant is used in a phosphoric acid based rinse solution according to this invention.

The aluminum ion sequestrant sequesters, that is, bonds, the dissolved aluminum, thus blocking its ionic activity and removing or eliminating the disturbance to the rinsing function of the phosphoric acid.

The aluminum ion sequestrant should preferably be added to the rinse solution in amounts ranging from 0.01 to 10.0 g/L, more preferably from 0.1to 3.0 g/L. Addition of the aluminum ion sequestrant in this range raises the permissible practical aluminum ion content in the rinse solution to a maximum of 10 g/L. If the aluminum ion sequestrant were not present in the acid rinse solution, the permissible aluminum ion concentration in the aqueous phosphoric acid solution would be approximately 500 ppm, and the etching effectiveness would be degraded by aluminum ion concentrations in excess of this level. In particular, smut reaction product would tend to remain on the aluminum surface, and the treatability of the aluminum surface in any subsequent conversion treatment would be degraded.

One previously known method for avoiding this inhibition of etching effectiveness by accumulation of aluminum ions in the etching solution consists of automatically draining a suitable amount of rinse solution from the system and replenishing with fresh solution. Since this method suffers from a high rinse solution loss, it increases the cost of the rinse. In contrast, the rinse solution of the present invention provides for an increase in the permissible aluminum ion concentration, and the automatically drained quantity can be reduced to the corresponding degree. At the same time, rinse solution manageability is improved, and the cost of the rinse can be reduced.

The aluminum ion sequestrant component in the solution according to the invention consists of one or more compounds selected from among sulfuric acid, organic acids, boric acid, condensed phosphoric acids, organophosphonic acids, and phosphorous acid. Organic acid sequestrants preferably are polybasic and/or hydroxy acids, for example, oxalic acid; lactic acid, glycolic acid, tartaric acid; and citric acid. The term "condensed phosphoric acids" encompasses pyrophosphoric acid ($H_4P_2O_7$), tripolyphosphoric acid ($H_5P_3O_{10}$), and tetrapolyphosphoric acid ($H_6P_4O_{13}$). The organophosphonic acid are exemplified by and if used are preferably selected from among, the compounds in the three groups of compounds (A) to (C) noted immediately below. However, the use of group (A) compounds is most preferred.

GENERAL FORMULA (A)

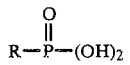

wherein

R represents a substituted alkyl group having one to five carbon atoms and at least one substituent from the group of —OH, —COOH, and —PO(OH)$_2$. An example is hydroxyethylidene-1,1-diphosphonic acid:

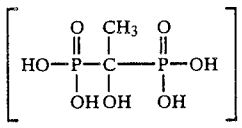

(B) aminotri(methylenephosphonic acid):

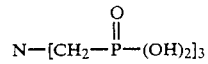

(C) ethylenediaminetetra(methylenephosphonic acid):

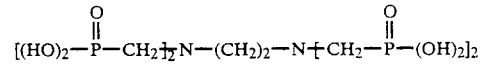

One or more compounds selected without restriction from those listed above is used in the rinse solution as an aluminum ion sequestrant. The concentration of aluminum ion sequestrant preferably should range from 0.01to 10.0 g/L. The sequestration effect is weak at a sequestrant concentration less than 0.01 g/L. The etching capacity and capacity for removing smut from the aluminum surface are then readily reduced by the accumulation of aluminum ion in the rinse solution during use. In contrast, an upper limit of 10.0 g/L is preferred because no further improvement in sequestration is apparent at higher sequestrant concentrations. A sequestrant content of 0.1 to 3.0 g/L is particularly preferred.

Ferric ion may be added as, for example, ferric sulfate or ferric nitrate. When the $Fe^{+3}$ concentration is less than 20 ppm, corrosion of stainless rinse equipment and conveyer systems, and particularly corrosion of the hold-down belt conveyer in aluminum can spray rinse systems, is only weakly inhibited, and damaging corrosion of this equipment can readily occur. No substantial improvement in corrosion inhibition appears with ferric ion concentrations in excess of 170 ppm, and an upper limit of around 170 ppm is therefore preferred. Maintenance of at least 50 ppm of ferric ions in the rinse solutions is particularly preferred.

$H_2O_2$ or $NO_2^{-1}$ is preferably added as oxidant in an amount of 0.02 to 3.0 g/L. As in the case of $Fe^{+3}$, this oxidant itself functions to passivate the surface of the rinse and transport equipment. In addition, by oxidizing $Fe^{+2}$ ions produced by $Fe^{+3}$ ion reduction back to ferric ion, this oxidant functions to maintain the activity described above for $Fe^{+3}$. These effects are inadequate when the oxidant concentration is less than 0.02 g/L, while no discernible improvement in effect is exhibited at above 3.0 g/L and the preferred upper limit is therefore chosen at 3.0 g/L. The $H_2O_2$ or $NO_2^{-1}$ is more preferably used at 0.1 to 1.0 g/L. Examples of compounds for the addition of $NO_2^{-1}$ to the rinse solution are $KNO_2$ and $NaNO_2$. Since these compounds readily produce $NO_x$ gas when added rinse solution, the use of $H_2O_2$ is generally preferred The pH of the rinse solution should preferably range from 0.6 to 2.0. The concentration of phosphoric acid in the rinse solution should preferably range from 3.0 to 50 g/L of stoichiometric equivalent as $PO_4^{-3}$, and the range from 4.0 to 15 g/L is particularly preferred. The rinse performance is inadequate when the $PO_4^{-3}$ concentration is less than 3.0 g/L. In contrast, the rinse performance no longer improves substantially at a concentration above 50 g/L.

Surfactant can be used in the rinse solutions according to the invention at 0.05 to 5.0 g/L and particularly preferably at 0.5 to 2.0 g/L, for the purpose of improving the rinsing effectiveness in removing oil adhered on the aluminum surface or by reducing the surface tension of the rinse solution. The type of surfactant is not crucial; however, the following three types (1) to (3) are preferred. An arbitrary selection may be made from these or other surfactants and added to the rinse solution.

(1) Alkyl ether surfactants expressed by the general formula $R(OR')_nOH$, wherein R represents an alkyl and alkylaryl groups having 8 to 22 carbon atoms; R' represents a divalent group selected from among ethylene, propylene, and their mixtures; and n is an integer.

(2) Abietic acid derivative surfactants expressed by the general formula $A(R'O)_nH$, wherein A represents an abietyl group and R' and n have the same meanings as above.

(3) Alkyldimethylamine oxide surfactants expressed by the general formula:

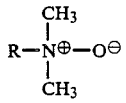

wherein

R represents an alkyl group having 12 to 22 carbon atoms.

A rinse solution according to this invention is normally used, in a process embodiment of the invention, at temperatures ranging from room temperature to 80° C., preferably at 50° to 60° C., by spray or immersion methods, and particularly by spray methods. In contrast, a high temperature of at least 70° C. is generally required to obtain satisfactory etching with sulfuric acid based etchants. In a process embodiment of this invention, the ferric ion content can be continuously replenished, so that the component (D) as shown above for composition embodiments of the invention is not strictly necessary. In practice, however, it is generally preferable to have component (D) present to avoid the need for external replenishment of the ferric ion content.

A characteristic feature of the acid rinse solution of the present invention is the presence of 20 to 170 ppm ferric ion. The ferric ion at this concentration in this solution does not promote the acid etching of aluminum. It was discovered that its presence in the aforesaid quantity can substantially inhibit the acid caused destruction of the surface passivating film on, and corrosion of, stainless steel rinse equipment and particularly the stainless steel conveyer normally used in spray rinsing. In order to avoid hindering this corrosion inhibiting effect, it is strongly preferred that the acid rinse solution of the present invention not contain chloride or chlorate.

An oxidant in addition to ferric ion, preferably $H_2O_2$ or $NO_2^{-1}$, is preferably used in the solutions according to the invention in order to reverse reduction of ferric ions to ferrous ions that occurs during the rinse operation. The oxidant concentration preferably should fall within the range of 20 ppm to 3.0 g/L, which can maintain the ferric ion concentration at or above 20 ppm even during prolonged use of the rinse solution.

Several illustrative working and comparison examples are given below in order to make more explicit the practice of the present invention, without limiting it.

EXAMPLES

Example 1

(1) Rinse Solution

A solution was prepared containing 6 g/L as 100% phosphoric acid, 1 g/L as 100% sulfuric acid as aluminum ion sequestrant, 1.79 g/L of 10% aqueous $Fe_2(SO_4)_3$ solution to give 50 ppm $Fe^{+3}$ ion, 0.5 g/L of $H_2O_2$, 0.4 g/L of nonionic surfactant type (1), and 0.4 g/L of nonionic surfactant of type (2).

(2) Test material

Containers carrying lubricating oil and smut, as used and developed respectively during conventional drawing and ironing (hereinafter "DI") processing of 3004 aluminum alloy sheet.

(3) Treatment conditions

Containers as above were treated by spraying with the particular rinse solution at 60° to 75° C. for 50 seconds, then washed with tap water for 10 seconds by spraying, subsequently washed with a deionized water spray, and dried at 180° C.

After this treatment, the test material and equipment were evaluated for smut removal, water wettability, and equipment corrosion, and these results are reported in Table 2.

Examples 2–7 and Comparison Examples 1–4

These examples were performed in the same manner as for Example 1, but with different rinse solutions. The compositions of these rinse solutions are given in Table 1. (The numbers used for the types of surfactants in all Examples are explained above in the specification.) The results are summarized in Table 2.

The numerical values for external appearance in Table 2 represent visual judgments of the whiteness of the dried containers treated, according to the following scale: 5=white over the whole surface (best); 4=very slightly grayish surface; 3=slightly grayish surface; 2=partly gray surface; 1=completely gray surface.

The test for smut removal reported in Table 2 is performed by adhering transparent adhesive tape to an inside surface of the dried container, peeling off the tape, and placing it on a white background to observe the degree of darkness on the tape according to the following scale: 5=no observable darkening on the tape (best); 4=slight patchy darkening; 3=slight overall darkening; 2=medium overall darkening; 1=blackening of the tape

TABLE 1

| | phosphoric acid | aluminum ion sequestrant | | ferric ion | oxidant | surfactant | | pH | T | admixed aluminum ion |
|---|---|---|---|---|---|---|---|---|---|---|
| examples | | | | | | | | | | |
| 1 | 6 g/L | $H_2SO_4$ | 1 g/L | 0.05 g/L | 0.5 g/L | nonionic (1) | 0.4 g/L | 1.57 | 70° C. | 1.5 g/L |
| | | | | | | nonionic (2) | 0.4 g/L | | | |
| 2 | 15 g/L | $H_2SO_4$ | 1 g/L | 0.15 g/L | 0.5 g/L | nonionic (1) | 0.4 g/L | | | |
| | | | | | | nonionic (2) | 0.4 g/L | 1.37 | 60° C. | 1.5 g/L |
| | | | | | | nonionic/ cationic (3) | 0.1 g/L | | | |
| 3 | 6 g/L | organophos- | 0.5 g/L | 0.1 g/L | 0.5 g/L | nonionic (1) | 0.4 g/L | 1.8 | 70° C. | 1.5 g/L |

TABLE 1-continued

| | phosphoric acid | aluminum ion sequestrant | | ferric ion | oxidant | surfactant | | pH | T | admixed aluminum ion |
|---|---|---|---|---|---|---|---|---|---|---|
| | | phonic acid | | | | nonionic (2) | 0.4 g/L | | | |
| | | $H_2SO_4$ | 0.1 g/L | | | | | | | |
| 4 | 6 g/L | organophos-phonic acid | 0.5 g/L | 0.1 g/L | 0.5 g/L | nonionic (1) | 0.4 g/L | 1.8 | 60° C. | 1.5 g/L |
| | | $H_2SO_4$ | 0.1 g/L | | | | | | | |
| 5 | 3 g/L | $H_2SO_4$ | 1 g/L | 0.1 g/L | 0.5 g/L | nonionic (2) | 0.4 g/L | 1.63 | 70° C. | 0.3 g/L |
| 6 | 6 g/L | $H_2SO_4$ | 0.1 g/L | | | nonionic (1) | 4 g/L | | | |
| | | citric acid | 0.4 g/L | 0.15 g/L | 1 g/L | | | 1.61 | 65° C. | 1.5 g/L |
| | | oxalic acid | 0.4 g/L | | | nonionic (2) | 4 g/L | | | |
| 7 | 6 g/L | $H_2SO_4$ | 3 g/L | 0.15 g/L | 0.5 g/L | nonionic (1) | 0.4 g/L | 1.36 | 70° C. | 1.5 g/L |
| | | | | | | nonionic (2) | 0.4 g/L | | | |
| 8 | 50 g/L | $H_2SO_4$ | 0.01 g/L | 0.15 g/L | 0.5 g/L | nonionic (1) | 0.4 g/L | 1.1 | 60° C. | 1.5 g/L |
| | | | | | | nonionic (2) | 0.4 g/L | | | |
| comparison examples | | | | | | | | | | |
| 1 | 0 g/L | $H_2SO_4$ | 10 g/L | 0.1 g/L | 0.5 g/L | nonionic (1) | 0.4 g/L | 1.0 | 70° C. | 1.5 g/L |
| 2 | 6 g/L | 0 g/L | | 0.1 g/L | 0.1 g/L | nonionic (2) | 0.4 g/L | 1.8 | 70° C. | 0.5 g/L |
| 3 | 0 g/L | $H_2SO_4$ | 12.5 g/L | 1.0 g/L | 1.0 g/L | nonionic (1) | 0.4 g/L | 0.9 | 70° C. | 1.5 g/L |
| | | | | | | nonionic (2) | 0.4 g/L | | | |
| 4 | 0 g/L | $H_2SO_4$ | 3 g/L | 0 g/L | 0 g/L | nonionic (1) | 0.4 g/L | 1.4 | 70° C. | 0.3 g/L |
| 5 | 50 g/L | 0 g/L | | 0.15 g/L | 0.5 g/L | nonionic (1) | 0.4 g/L | 1.36 | 70° C. | 1.5 g/L |
| | | | | | | nonionic (2) | 0.4 g/L | | | |

TABLE 2

| | external appearance | smut removal | water wettability | equipment corrosion |
|---|---|---|---|---|
| examples | | | | |
| 1 | 5 | 5 | 100% | not detected |
| 2 | 5 | 5 | 100% | not detected |
| 3 | 5 | 5 | 100% | not detected |
| 4 | 4 | 4 | 100% | not detected |
| 5 | 4 | 4 | 100% | not detected |
| 6 | 5 | 5 | 100% | not detected |
| 7 | 5 | 5 | 100% | not detected |
| 8 | 5 | 5 | 100% | not detected |
| comparison examples | | | | |
| 1 | 2 | 2 | 80% | not detected |
| 2 | 2 | 2 | 80% | not detected |
| 3 | 3 | 3 | 90% | not detected |
| 4 | 2 | 2 | 80% | substantial corrosion |
| 5 | 3 | 3 | 90% | not detected |

overall.

The percentage values for water wettability reported in Table 2 are the percentage of the surface still wet with a water film 30 seconds after rinsing the treated container with clean water.

What is claimed is:

1. A liquid composition of matter comprising water and:

(A) orthophosphoric acid in an amount to give a stoichiometric equivalent of about 3.0 to about 50 g/L as $PO_4^{-3}$;

(B) an aluminum ion sequestrant component in an amount of about 0.01 to about 10.0 g/L;

(C) about 20 to about 170 ppm of ferric ion; and (D) a sufficient amount of oxidizing agent to maintain the concentration of ferric ion at or above 20 ppm during rinsing of at least 50 square meters of aluminum with one liter of said liquid composition of matter, said liquid composition of matter being free from any amount of chromium ion, fluoride, chloride, or chlorate that is sufficient to impair the functioning of said aqueous composition as a rinse solution for aluminum or to increase the cost of disposal of a composition formed by utilizing said composition as a rinse solution for aluminum until its utility as such a rinse solution is exhausted.

2. A liquid composition of matter according to claim 1, wherein component (D) includes from about 0.02 to about 3 about 3.0 g/L of $H_2O_2$, $NO_2^{-1}$ ions, or a mixture thereof.

3. A liquid composition of matter according to claim 2, wherein the aluminum ion sequestrant component is selected from the group consisting of sulfuric acid, organic acids, boric acid, condensed phosphoric acids, organophosphonic acids, and phosphorous acid.

4. A liquid composition of matter according to claim 3, additionally comprising from about 0.05 to about 5.0 g/L of surfactant.

5. A liquid composition of matter according to claim 2, additionally comprising from about 0.05 to about 5.0 g/L of surfactant.

6. A liquid composition of matter according to claim 5, wherein the amount of component (A) is from about 4.0 to about 15 g/L; the amount of component (B) is from about 0.1 to about 3.0 g/L, the amount of component (C) is at least about 50 ppm, the amount of component (D) is from about 0.1 to about 1.0 g/L, and the pH of the composition is from about 0.6 to about 2.0.

7. A liquid composition of matter according to claim 4, wherein the amount of component (A) is from about 4.0 to about 15 g/L; the amount of component (B) is from about 0.1 to about 3.0 g/L, the amount of component (C) is at least about 50 ppm, the amount of component (D) is from about 0.1 to about 1.0 g/L, and the pH of the composition is from about 0.6 to about 2.0.

8. A liquid composition of matter according to claim 3, wherein the amount of component (A) is from about 4.0 to about 15 g/L; the amount of component (B) is from about 0.1 to about 3.0 g/L, the amount of component (C) is at least about 50 ppm, the amount of component (D) is from about 0.1 to about 1.0 g/L, and the pH of the composition is from about 0.6 to about 2.0.

9. A liquid composition of matter according to claim 2, wherein the amount of component (A) is from about 4.0 to about 15 g/L; the amount of component (B) is from about 0.1 to about 3.0 g/L, the amount of component (C) is at least about 50 ppm, the amount of component (D) is from about 0.1 to about 1.0 g/L, and the pH of the composition is from about 0.6 to about 2.0.

10. A liquid composition of matter according to claim 1, wherein the amount of component (A) is from about 4.0 to about 15 g/L; the amount of component (B) is from about 0.1 to about 3.0 g/L, the amount of component (C) is at least about 50 ppm, the amount of component (D) is from about 0.1 to about 1.0 g/L, and the pH of the composition is from about 0.6 to about 2.0.

11. A liquid composition of matter according to claim 2 which contains an amount of orthophosphoric acid that is stoichiometrically equivalent to from about 4.0 to about 15 g/L of $PO_4^{-3}$.

12. A liquid composition of matter according to claim 2 which contains from about 0.1 to about 3.0 g/L of aluminum ion sequestrant.

13. A liquid composition of matter according to claim 2 which contains at least about 50 ppm of ferric ions.

14. A liquid composition of matter according to claim 2 which contains from about 0.1 to 1.0 g/L of component (D).

15. A liquid composition of matter according to claim 2 in which the pH is from about 0.6 to about 2.0.

16. A liquid composition of matter according to claim 1, additionally comprising from about 0.05 to about 5.0 g/L of surfactant.

17. A liquid composition of matter according to claim 1 which contains an amount of orthophosphoric acid that is stoichiometrically equivalent to from about 4.0 to about 15 g/L of $PO_4^{-3}$.

18. A liquid composition of matter according to claim 1 which contains from about 0.1 to about 3.0 g/L of aluminum ion sequestrant.

19. A liquid composition of matter according to claim 1 which contains at least about 50 ppm of ferric ions.

* * * * *